US008044824B2

(12) United States Patent
Vu et al.

(10) Patent No.: US 8,044,824 B2
(45) Date of Patent: Oct. 25, 2011

(54) ELECTRONIC BARRIER AND ENFORCEMENT SYSTEM AND METHOD

(75) Inventors: Patrick Vu, Atlanta, GA (US); Jannine Miller, Atlanta, GA (US); Randall Guensler, Atlanta, GA (US); Teresa Slack, Atlanta, GA (US); John Breedlove, Alpharetta, GA (US)

(73) Assignees: State Road and Tollway Authority, Atlanta, GA (US); Georgia Tech Research Corporation, Atlanta, GA (US)

( * ) Notice: Subject to any disclaimer, the term of this patent is extended or adjusted under 35 U.S.C. 154(b) by 384 days.

(21) Appl. No.: 12/170,322

(22) Filed: Jul. 9, 2008

(65) Prior Publication Data

US 2009/0016819 A1 Jan. 15, 2009

Related U.S. Application Data

(60) Provisional application No. 60/958,759, filed on Jul. 9, 2007.

(51) Int. Cl.
*G08G 1/17* (2006.01)

(52) U.S. Cl. ..... 340/937; 340/933; 701/117; 342/44; 342/454

(58) Field of Classification Search ..... 340/937, 340/933, 506; 701/117; 342/44, 454; 235/384, 235/436

See application file for complete search history.

(56) References Cited

U.S. PATENT DOCUMENTS 6,042,008 A * 3/2000 Ando et al. ..... 235/384
7,528,739 B2 * 5/2009 Kojima ..... 340/928
7,667,618 B2 * 2/2010 Chitor et al. ..... 340/933
2003/0069029 A1 4/2003 Dowling et al. ..... 455/456.1
2004/0049424 A1 3/2004 Murray et al. ..... 705/14.14
2006/0056658 A1 * 3/2006 Kavner ..... 382/105

OTHER PUBLICATIONS

U.S. Appl. No. 12/170,366, Miller, filed Jul. 9, 2008, Response to Restriction Requirement, Jun. 2, 2010.

U.S. Appl. No. 12/170,366, Miller, filed Jul. 9, 2008, Restriction Requirement, Apr. 28, 2010.

Chris R. Swenson, P.E., *HOT Lane Operating and Enforcement Concept*, CRSPE, Inc., 2000, 10 pages.

*Appendix A—Benefits Associated with Requiring Transponder Use by All Vehicles in HOT Lanes*, CRSPE, Inc., 2000, 6 pages.

*Enforcement needed on 91 Express Lanes—Lane Crashers*, Toll Road News, Sep. 12, 2006, 5 pages, http://www.tollroadsnews.com/node/1652.

U.S. Appl. No. 12/170,366, Miller, filed Jul. 9, 2008, Non-Final Rejection, Aug. 11, 2010.

U.S. Appl. No. 12/170,366, Miller, filed Jul. 9, 2008, Amendment and Response to Office Action, Nov. 12, 2010.

U.S. Appl. No. 12/170,366, Miller, filed Jul. 9, 2008, Final Rejection, Jan. 28, 2011.

U.S. Appl. No. 12/170,366, Miller, filed Jul. 9, 2008, Request for Continued Examination, Amendment, and Response to Office Action, Apr. 28, 2011.

* cited by examiner

*Primary Examiner* — Brent Swarthout
*Assistant Examiner* — Hongmin Fan
(74) *Attorney, Agent, or Firm* — Ballard Spahr LLP

(57) ABSTRACT

Disclosed are systems and methods for implementing an electronic tollway barrier system. Exemplary systems and methods use positive vehicle identification at progressive monitoring locations to determine whether a vehicle has illegally entered a controlled lane across the electronic barrier, ensure that toll locations are not circumvented, and automatically issue citations to violators of the electronic barrier.

12 Claims, 8 Drawing Sheets

Dedicated HOT/HOV lane 400

HOT/HOV lane based on daily/weekly schedule 500

General Purpose lane 600

ELECTRONIC BARRIER AND ENFORCEMENT SYSTEM AND METHOD

CROSS REFERENCE TO RELATED PATENT APPLICATION

This application claims benefit of and priority to U.S. Provisional Application No. 60/958,759 titled "HOV/HOT Invisible Barrier," filed Jul. 9, 2007, which is incorporated herein by reference in its entirety and made a part hereof.

BACKGROUND

Due to the engineering and enforcement constraints along certain urban freeway corridors, it is not always feasible to construct physical barriers to separate traffic in general purpose travel lanes from traffic in managed lanes. Some current high-occupancy vehicle (HOV) and high-occupancy tollway (HOT) systems, as are known in the art, utilize double-striped solid painted lines to separate HOV/HOT lanes from the general purposes lanes, with skip line breaks in the double white lines to indicate when entry into and out of the HOV/HOT lanes is allowed. It is in these zones (zones with skip line breaks in the double white lines) that weaving into and out of the HOV/HOT lane is allowed to occur. From an engineering operations perspective, it is critical that weaving activity be confined to these zones. Unexpected weaving activity results in a significant decrease in the effective capacity of an HOV/HOT lane and reduces transportation system performance. As such, most municipalities or other enforcement agencies will issue traffic citations to drivers who cross the double white lines, entering or exiting the lanes at other than designated entry and exit points. However, enforcement effectiveness is usually a function of the visible enforcement presence and available manpower resources. In many areas, enforcement activities may be limited due to factors including, but not limited to, enforcement staff being unable to reach lane violators when traffic is congested; enforcement activity impeding vehicle throughput on general purpose lanes, reducing system performance; and officers being at risk when there are no safe locations available for vehicles to pull over and receive a citation. As such, enforcement of HOV/HOT violations is often not undertaken or is undertaken halfheartedly in areas with congestion problems.

Therefore, what is desired are systems and methods that overcome challenges found in the art, some of which are described above.

SUMMARY

Described herein are embodiments of an HOV/HOT electronic barrier with automated enforcement system and method, which are designed to reduce the need for a physical barrier between HOV/HOT and general purpose lanes and also address enforcement problems through the implementation of automated electronic enforcement of barrier integrity. The embodiments of an electronic barrier described herein can be used to replace traditional enforcement activities with a technology solution, increasing the performance of the transportation system, reducing the overall costs of enforcement, and saving the lives of traffic enforcement personnel.

In one aspect described herein is an electronic barrier and enforcement system. This aspect of a system is comprised of a processor, a memory, and a plurality of sensing devices located in series along one or more lanes of travel of a roadway system. The sensing devices are operably connected to the processor, wherein at least a portion of the plurality of sensing devices are configured to detect a presence of each of one or more vehicles in the one or more lanes of the roadway system. The processor is configured to determine whether one of the one or more vehicles that is detected by a first sensing device of the at least a portion of the plurality of sensing devices is also detected by at least a second sensing device of the at least a portion of the plurality of sensing devices. In another aspect, the system further comprises one or more identity devices. The one or more identity devices are configured to individually identify each of the one or more vehicles detected by each of the at least a portion of the plurality of sensing devices.

In another aspect of the system described above, the processor is further configured to determine if one of said one or more vehicles that is detected by the first sensing device of the at least a portion of the plurality of sensing devices is not detected by the second sensing device of the at least a portion of the plurality of sensing devices, then the identity of the one of said one or more vehicles is recorded in the memory by the processor for use in an enforcement action or for toll collection.

In another aspect, the system described above further comprises a transportation operations database that comprises roadway segment information, including one or more electronic barrier entry points and corresponding electronic barrier exit points, roadway operating conditions, and roadway segment toll price; and a vehicle registration database that links vehicle identity information to a registered vehicle owner. The processor is configured to compare the presence of each of one or more vehicles in the one or more lanes of the roadway system to the transportations operations database and whether one of said one or more vehicles that is detected by a first sensing device of the at least a portion of the plurality of sensing devices is also detected by at least a second sensing device of the at least a portion of the plurality of sensing devices to determine when a vehicle has illegally crossed into the one or more lanes of the roadway system. The vehicle identity information is compared to the vehicle registration database to determine the registered owners of the one or more vehicles in the one or more lanes of the roadway system and to issue a citation to the registered vehicle owner of the one or more vehicles in the one or more lanes of the roadway system.

In yet another aspect, a method for electronic barrier and automated enforcement is described herein. The method comprises defining an electronic barrier comprised of segments of one or more lanes of a roadway system and electronic barrier entry points and corresponding electronic barrier exit points, detecting a presence of each of one or more vehicles in the electronic barrier, identifying each of the one or more vehicles detected in the electronic barrier, and determining whether each of the one or more vehicles has entered or exited the electronic barrier at an impermissible location.

Additional advantages will be set forth in part in the description which follows, or may be learned by practice. It is to be understood that both the foregoing general description and the following detailed description are exemplary and explanatory only and are not restrictive.

BRIEF DESCRIPTION OF THE DRAWINGS

Various features and advantages of the present invention may be more readily understood with reference to the following detailed description taken in conjunction with the accompanying drawings, not drawn to scale, wherein like reference numerals designate like structural elements, and in which.

DETAILED DESCRIPTION

Figure 1:
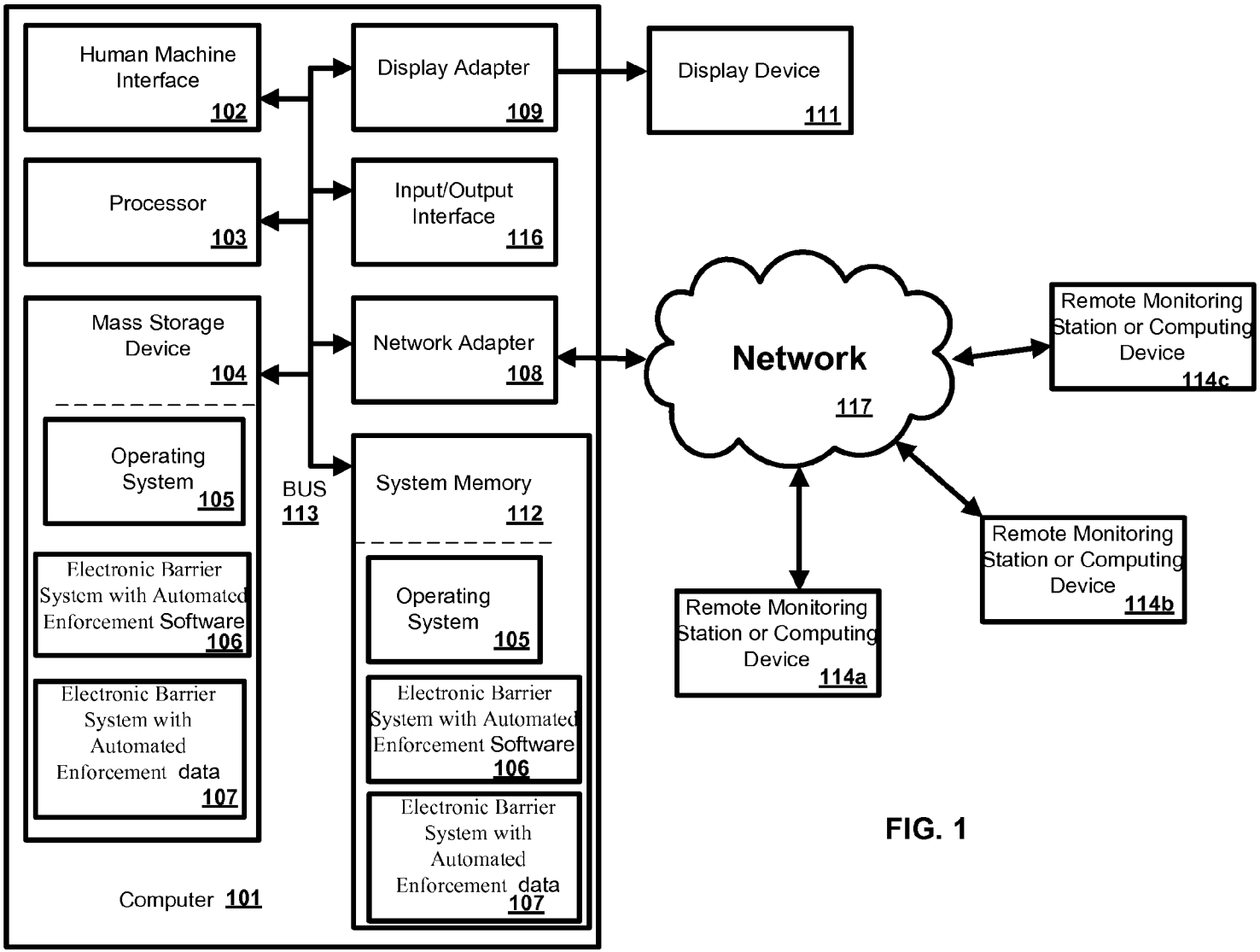
FIG. 1 illustrates a simplified, non-limiting block diagram showing an exemplary operating environment for performing disclosed methods.

The present embodiments may be understood more readily by reference to the following detailed description of the embodiments and the examples included therein and to the figures and their previous and following description.

Before the present systems, articles, devices, and/or methods are disclosed and described, it is to be understood that this description is not limited to specific systems, specific devices, or to particular methodology, as such may, of course, vary. It is also to be understood that the terminology used herein is for the purpose of describing particular embodiments only and is not intended to be limiting.

The following description is provided as an enabling teaching of the system and method in its best, currently-known embodiment. To this end, those skilled in the relevant art will recognize and appreciate that many changes can be made to the various aspects of the systems and methods described herein, while still obtaining the beneficial results of the present systems and methods. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used in the specification and the appended claims, the singular forms "a," "an" and "the" include plural referents unless the context clearly dictates otherwise.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed, the "less than or equal to 10" as well as the "greater than or equal to 10" is also disclosed. It is also understood that throughout the application, data is provided in a number of different formats and that this data represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

"Optional" or "optionally" means that the subsequently described event or circumstance may or may not occur, and that the description includes instances where said event or circumstance occurs and instances where it does not.

"Exemplary," where used herein, means "an example of" and is not intended to convey a preferred or ideal embodiment. Further, the phrase "such as" as used herein is not intended to be restrictive in any sense, but is merely explanatory and is used to indicate that the recited items are just examples of what is covered by that provision.

As will be appreciated by one skilled in the art, the present invention may be embodied as a method, a system, or a computer program product. Accordingly, the present invention may take the form of an entirely hardware embodiment, an entirely software embodiment, or an embodiment combining software and hardware aspects. Furthermore, the present invention may take the form of a computer program product on a computer-readable storage medium having computer-readable program instructions (e.g., computer software) embodied in the storage medium. More particularly, the present invention may take the form of web-implemented computer software. Any suitable computer-readable storage medium may be utilized including hard disks, CD-ROMs, optical storage devices, or magnetic storage devices.

Embodiments herein are described below with reference to block diagrams and flowchart illustrations of methods, systems, apparatuses and computer program products according to an embodiment of the invention. It will be understood that some blocks of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture, including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process, such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

FIG. 1 is a block diagram illustrating an exemplary operating environment for performing disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well known computing systems, environments, and/or configurations that can be suitable for use with the system and method comprise, but are not limited to, personal computers, server computers, laptop devices, hand-held electronic devices, vehicle-embedded electronic devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed system and method can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed method can also be practiced in grid-based and distributed computing environments where tasks are performed by remote processing devices that are linked through a communications network. In a distributed computing environment, program modules can be located in both local and remote computer storage media, including memory storage devices.

Further, one skilled in the art will appreciate that the system and method disclosed herein can be implemented via a general-purpose computing device in the form of a computer 101. The components of the computer 101 can comprise, but are not limited to, one or more processors or processing units 103, a system memory 112, and a system bus 113 that couples various system components including the processor 103 to the system memory 112. In the case of multiple processing units 103, the system can utilize parallel computing.

The system bus 113 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI) bus also known as a Mezzanine bus. The bus 113, and all buses specified in this description can also be implemented over a wired or wireless network connection, and each of the subsystems, including the processor 103, a mass storage device 104, an operating system 105, Electronic Barrier System with Automated Enforcement software 106, Electronic Barrier System with Automated Enforcement data 107, a network adapter 108, system memory 112, an Input/Output Interface 116, a display adapter 109, a display device 111, and a human machine interface 102 that can include a graphical user interface (GUI), can be contained within one or more remote computing devices 114*a,b,c* at physically separate locations, connected through buses of this form, in effect implementing a fully distributed system.

The computer 101 typically comprises a variety of computer readable media. Exemplary readable media can be any available media that is accessible by the computer 101 and comprises, for example and not meant to be limiting, both volatile and non-volatile media, removable and non-removable media. The system memory 112 comprises computer readable media in the form of volatile memory, such as random access memory (RAM), and/or non-volatile memory, such as read only memory (ROM). The system memory 112 typically contains data such as Electronic Barrier System with Automated Enforcement data 107 and/or program modules such as operating system 105 and Electronic Barrier System with Automated Enforcement software 106 that are immediately accessible to and/or are presently operated on by the processing unit 103.

In another aspect, the computer 101 can also comprise other removable/non-removable, volatile/non-volatile computer storage media. By way of example, FIG. 1 illustrates a mass storage device 104 which can provide non-volatile storage of computer code, computer readable instructions, data structures, program modules, and other data for the computer 101. For example and not meant to be limiting, a mass storage device 104 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 104, including by way of example, an operating system 105 and Electronic Barrier System with Automated Enforcement software 106. Each of the operating system 105 and Electronic Barrier System with Automated Enforcement software 106 (or some combination thereof) can comprise elements of the programming and the Electronic Barrier System with Automated Enforcement software 106. Electronic Barrier System with Automated Enforcement data 107 can also be stored on the mass storage device 104 as binary data, text data or in a database. Electronic Barrier System with Automated Enforcement data 107 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computer 101 via an input device (not shown). Examples of such input devices comprise, but are not limited to, a keyboard, pointing device (e.g., a "mouse"), a microphone, a joystick, a scanner, tactile input devices such as gloves, and other body coverings, and the like. These and other input devices can be connected to the processing unit 103 via a human machine interface 102 that is coupled to the system bus 113, but can be connected by other interface and bus structures, such as a parallel port, game port, an IEEE 1394 Port (also known as a Firewire port), a serial port, or a universal serial bus (USB).

In yet another aspect, a display device 111 can also be connected to the system bus 113 via an interface, such as a display adapter 109. It is contemplated that the computer 101 can have more than one display adapter 109 and the computer 101 can have more than one display device 111. For example, a display device can be a monitor, an LCD (Liquid Crystal Display), or a projector. In addition to the display device 111, other output peripheral devices can comprise components such as speakers (not shown) and a printer (not shown) which can be connected to the computer 101 via Input/Output Interface 116. Any step and/or result of the methods can be output in any form to an output device, The computer 101 can operate in a networked environment using logical connections to one or more remote monitoring stations or computing devices 114*a,b,c*. By way of example, a remote computing device can be a personal computer, portable computer, a server, a router, a network computer, a peer device or other common network node, virtual platform, and so on. Logical connections between the computer 101 and a remote monitoring station or computing device 114*a,b,c* can be made via wired networks, wireless networks or combinations thereof including a local area network (LAN or WLAN), a general wide area network (WAN or WWAN), virtual private networks (VPN), leased private networks, or any other network or ad-hoc, peer-to-peer communications process. Such network connections can be through a network adapter 108. A network adapter 108 can be implemented in both wired and wireless environments. Such networking environments are conventional and commonplace in offices, enterprise-wide computer networks, intranets, and across networks 117 such as the Internet. Messaging protocols, as are known to one of ordinary skill in the art, can be used for communications throughout the network 117.

For purposes of illustration, application programs and other executable program components such as the operating system 105 are illustrated herein as discrete blocks, although it is recognized that such programs and components reside at various times in different storage components of the computing device 101, and are executed by the data processor(s) 103 of the computer. An implementation of electronic barrier system with automated enforcement software 106 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer-readable media can comprise "computer storage media" and "communications media." "Computer storage media" comprise volatile and non-volatile, removable and non-removable media implemented in any method or technology for storage of information such as computer-readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and that can be accessed by a computer.

The methods and systems can employ artificial intelligence (AI) techniques such as machine learning and iterative learning. Examples of such techniques include, but are not limited to, expert systems, case based reasoning, Bayesian networks, behavior based AI, neural networks, fuzzy systems, evolutionary computation (e.g., genetic algorithms), swarm intelligence (e.g., ant algorithms), and hybrid intelligent systems (e.g., Expert inference rules generated through a neural network or production rules from statistical learning).

Disclosed are systems and methods for implementation of an electronic barrier system with automated enforcement capabilities for use with high-occupancy vehicle (HOV) and high-occupancy tollway (HOT) systems. The electronic system reduces the need for a physical barrier between HOV/HOT and general purpose lanes and also addresses enforcement through the implementation of automated electronic enforcement of barrier integrity.

In one embodiment, the methods and system includes a set of monitoring stations placed at strategic locations along the HOV/HOT lane to record the presence of vehicles at each station. As a vehicle in a plurality of vehicles pass the location of the monitoring station, the monitoring station records the identity of the vehicle. By monitoring progressive vehicle locations along the set of stations, the ingress or egress point of a vehicle into or out of a controlled lane can be determined.

In another embodiment, the monitoring stations may be placed relative to segments of roadway, where ingress or egress to/from controlled lanes is prohibitive, to allow for the detection of vehicles that have crossed into the controlled lane at restricted or unapproved locations.

Figure 2:
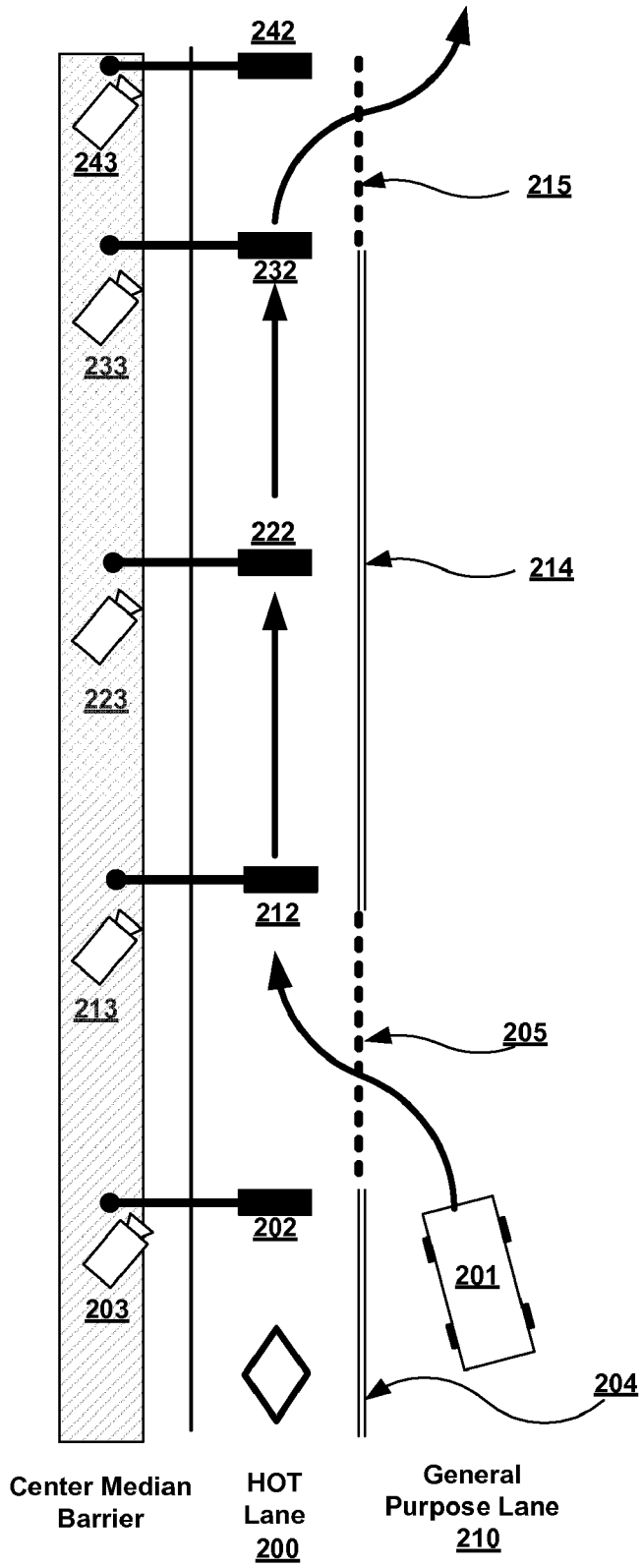
FIG. 2 illustrates a simplified, non-limiting example of a vehicle entering and exiting a controlled lane at permissible locations where monitoring stations and associated recording devices record the progress of the vehicle.

FIG. 2 illustrates a simplified non-limiting example of how the methods and system tracks vehicles in a controlled lane 200. In this illustration, a segment of a roadway consists of two intervals 204, 214 where ingress/egress to/from the controlled lane 200 is restricted and two intervals 205, 215 where ingress/egress to/from the controlled lane 200 is permitted. A first vehicle 201 in a plurality of vehicles enters the controlled lane 200 at a permitted location 205 along the roadway. As the first vehicle 201 passes the location of a monitoring station 212 the identity of the vehicle 201 can be recorded by an associated recording device 213. A monitoring station 212 can be comprised of a sensing device that sense the presence of a vehicle, an identity device that can be used to identify a vehicle (i.e., read its license plate, receive a transmission from the vehicle that identifies the vehicle, etc.), or a combination of a sensing device and an identity device. In one aspect, a sensing device and an identity device can be the same device, such as a camera. In some instances, a monitoring station 212 can be a "dummy" station that makes the operator of a vehicle believe that their presence in a controlled lane is being monitored or recorded.

Since the first vehicle 201 was on a general purpose lane 210 before entering the controlled lane 200, a previous monitoring station 202 does not record the identity of the vehicle 201. As the first vehicle 201 continues to travel down the roadway in the controlled lane 200, subsequent monitoring stations 222, 232 can record the identity of the first vehicle 201 as it passes the locations of those monitoring stations 222, 232. In this illustration, the first vehicle 201 exits the controlled lane 200 at the next permissible location 215 in the roadway. Because the first vehicle 201 is not in the controlled lane 200 when it passes the location of the subsequent monitoring station 242, the first vehicle's 201 identity is not recorded at the subsequent monitoring station 242.

By examining the records of the set of monitoring stations 202, 212, 222, 232, 242, the location of the first vehicle's 201 entry and exit to/from the controlled lane 200 may be determined. The first vehicle's 201 entry point can be determined by identifying the first monitoring station 212 which recorded the first vehicle 201. In FIG. 2, the first vehicle 201 is recorded by the monitoring station 212 after it has entered the controlled lane 200. Because the previous monitoring station 202 did not record the first vehicle 201 passing that location, the system may determine that the first vehicle entered the controlled lane between the two monitoring stations 202, 212. The first vehicle 201 is also recorded as passing other monitoring stations 222, 232 subsequent to entering the controlled lane 200. However, the monitoring station 242 after the point at which the first vehicle 201 exited the controlled lane 200 does not record the first vehicle 201. Because the subsequent monitoring station 242 does not record the first vehicle 201 passing that location, the system may determine that the first vehicle 201 exited the controlled lane between the two monitoring stations 232, 242.

Figure 3:
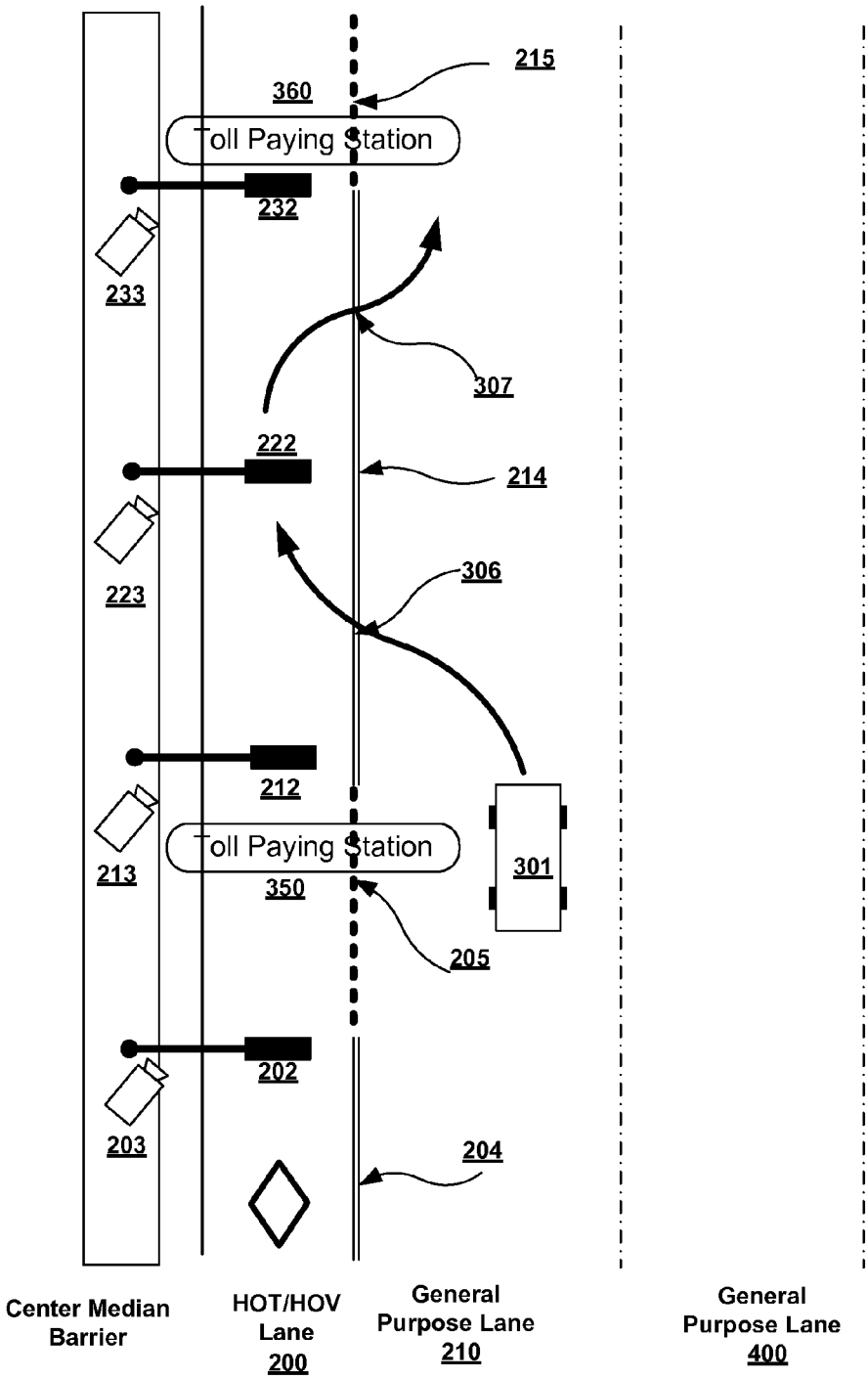
FIG. 3 illustrates a simplified, non-limiting example of a vehicle entering and exiting a controlled lane at restricted locations where monitoring stations and associated recording devices record the progress of the vehicle.

FIG. 3 illustrates a simplified non-limiting example of how the methods and system tracks vehicles entering or exiting a controlled lane 200. In this illustration, the segment of the roadway consists of two intervals 204, 214 where ingress/egress to/from the controlled lane 200 is restricted and two intervals 205, 215 where ingress/egress to/from the controlled lane 200 is permitted. A second vehicle 301 in the plurality of vehicles enters the controlled lane 200 at a location between two monitoring stations 212, 222. The second vehicle 301 can be recorded by one monitoring station 222 as the vehicle passes the location of that monitoring station 222. The second vehicle then exits the controlled lane 200 before passing the next monitoring station 232. Since the second vehicle was not in the controlled lane 200 when it passed the next monitoring station 232, the next monitoring station 232 does not record the second vehicle 301.

Because the previous monitoring station 212 did not record the second vehicle 301 passing that location, the system may determine that the second vehicle 301 entered the controlled lane between the two monitoring stations 212, 222. Because the subsequent monitoring station 232 did not record the second vehicle 301 passing that location, the system may determine that the second vehicle 301 exited the controlled lane between the two monitoring stations 222, 232. To increase the likelihood of detection of vehicles which may enter and exit a controlled lane, intermediate monitoring stations 222 may be deployed between permitted entry and exit locations on the controlled lane.

In one embodiment, the entry and exit locations of a vehicle may be used to determine if the vehicle's change in lanes was permissible. As illustrated in FIG. 2 and FIG. 3, by locating monitoring stations at the beginning and end of stretches of roadway where lane changes into or out of a controlled lane is prohibitive, the methods and system may determine on what part of the roadway the lane change was made and whether that stretch of roadway permits such lane changes. For example, it may be determined that the second vehicle 301 in FIG. 3 has entered and exited the controlled lane 200 at prohibited locations 306, 307 because the monitoring stations 212, 232 in FIG. 3 are located at the beginning and end of a section of the roadway where lane changes are prohibited and those monitoring stations 212, 232 did not record the second vehicle 301 passing those locations while the intermediate monitoring station 222 did record the second vehicle 301 passing that location.

In one embodiment, when a vehicle is identified as having entered the controlled lane illegally, the system may record the identity of the vehicle for enforcement purposes through manual observation or via technology implementation. For example, a human operator may record the license plate or photograph the vehicle from a roadside station, an automated license plate identification system may use video capture to record and identify the vehicle's license plate, or a roadside electronic identification system may record an identification signal broadcast from the vehicle, to name but a few non-limiting examples. A citation for the violation may then be mailed or electronically remitted to the driver or other responsible individual.

Figure 4:
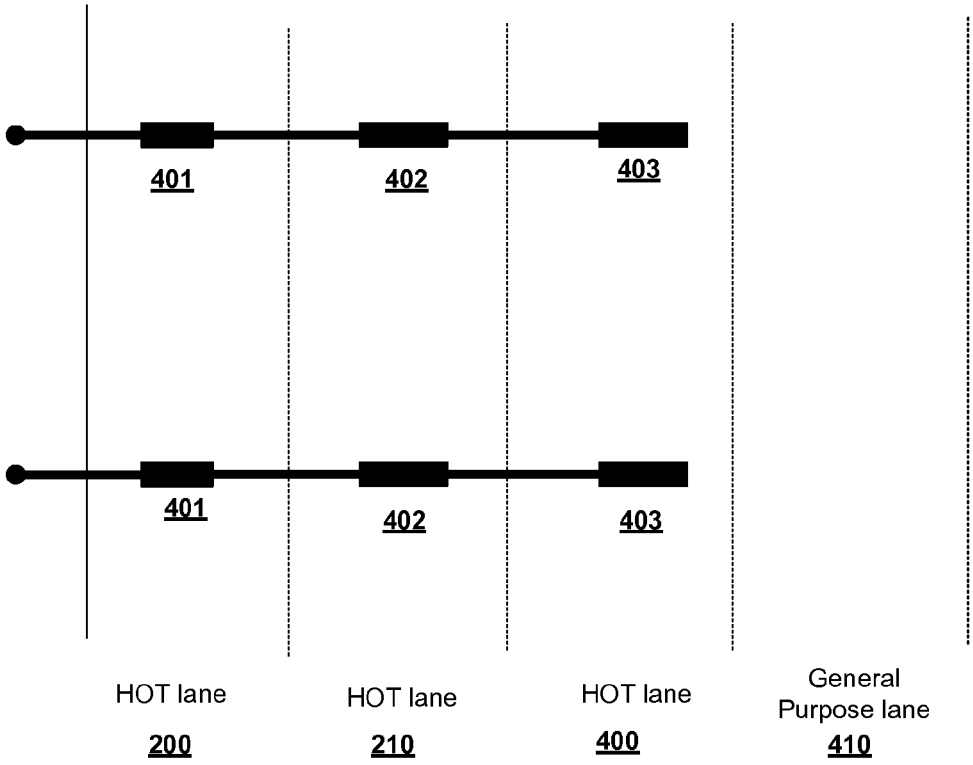
FIG. 4 illustrates a simplified, non-limiting example of expanding the electronic barrier and automated enforcement system to existing general purpose lanes.

In one embodiment, the electronic barrier system provides scalability. The monitoring stations may extend over or into additional lanes as they are converted to HOV/HOT lanes with minimal engineering retrofits. By way of example, FIG. 4 illustrates the expansion of the electronic barrier and automated enforcement system with minimal impact on additional roadway space or requirements for physical barrier systems. By adding more monitoring stations to existing general purpose lanes 210, 400, these lanes may be converted to HOV/HOT lanes.

Figure 5A:
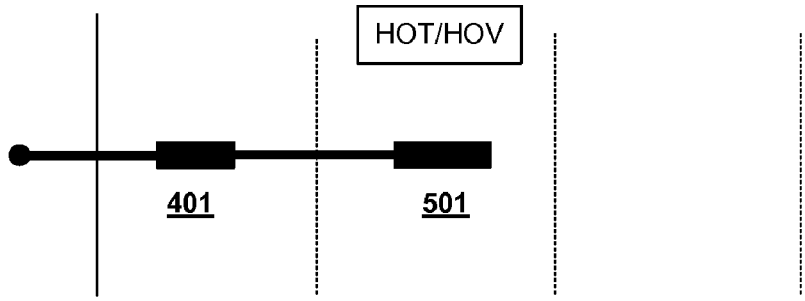
FIGS. 5A and 5B illustrate simplified, non-limiting examples of using the electronic barrier and automated enforcement system for multipurpose lanes.
Figure 5B:
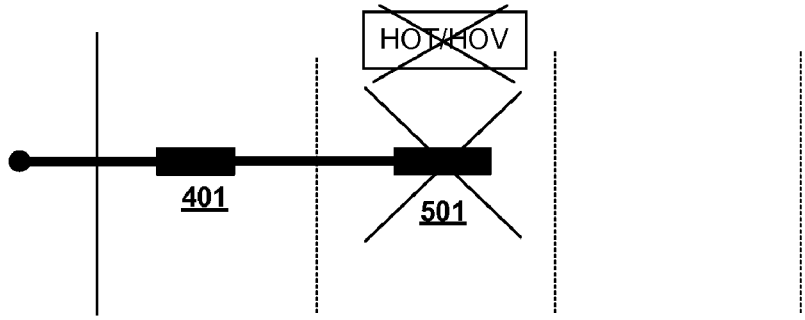

In yet another embodiment, the methods and system may be used to create multipurpose lanes. By way of example, FIG. 5A and FIG. 5B illustrate the usage of the methods and system described herein to create multi-purpose lanes, according to one embodiment. These illustrations show one dedicated HOV/HOT lane 400, one multipurpose lane 500 and one general purpose lane 600. The multipurpose lane 500 may be designated as a HOV/HOT lane or a general purpose lane depending on a variety of factors. For example, the multipurpose lane 500 may be designated as a HOV/HOT lane during various periods of the day or week such as mornings, afternoons, evenings, weekdays, weekends, work days, holidays, or other blocks of time as the user of the methods and system determines is necessary. In FIG. 5A, during the periods where the multipurpose lane 500 is designated a HOV/HOT lane, the monitoring station 501 associated with the lane 500 is active and perform the functions described herein. In FIG. 5B, during periods when the multipurpose lane 500 is not designated as a HOV/HOT lane, the monitoring station 501 may be deactivated or the data collected from the monitoring station 501 may be discarded or flagged. Because the methods and system may be controlled electronically, the need to place physical barriers may be unnecessary.

In another embodiment, the designation of a multipurpose lane as an HOV/HOT lane or a non-HOV/HOT lane may be based on factors other than time. For example, HOV/HOT lane designation may be based on anticipated construction, traffic disruptions, or effects on traffic patterns caused by special events.

In yet another embodiment, decoy monitoring stations (i.e., "dummy" stations) can also be deployed to increase deterrence.

The system may also be used to ensure that tolls on a HOT facility are properly assessed for those vehicles that may have passed a toll-collection sensor after entering a lane at a prohibitive location.

In one embodiment, the set of monitoring stations comprises toll sensors, located at entry/exit points to the managed lanes, and toll confirmation sensors, located strategically along the corridor between the entry/exit points. Sensor bundles may include presence detection equipment (also referred to herein as sensing devices) and positive vehicle identification equipment (also referred to herein as identity devices) and a variety of alternative technologies, as are known in the art to one of ordinary skill. Presence detectors may include, but are not limited to, video detection sensors, embedded magnetic sensors, radar sensors, etc. Examples of positive vehicle identification sensors and systems may include, but are not limited to, license plate recognition, gantry-mounted or pavement-embedded short range radio frequency identification, remote transmission, dedicated short-range communications, cellular communications, satellite communications, etc. The system may comprise as many monitoring stations as necessary to discourage vehicles from dodging in and out of the HOV/HOT lanes.

In another embodiment, the methods and system may be used for the monitoring and collection of tolls as part of a toll gantry network. As illustrated in FIG. 3, the toll gantry network may be comprised of toll paying stations 350, 360 located at entry/exit points 205, 215 along a corridor and confirmation monitoring stations 222 located strategically throughout the corridor between the entry/exit points 205, 215. If the vehicle 301 is recorded by the tolling system as not having entered the HOT lane by properly passing under an entry toll paying station 350, but other monitoring stations 222 detect the vehicle 301, then the tolling system may record the identity of the vehicle for possible citation. Vehicle identification may be achieved with either a violation enforcement camera taking photograph of the vehicle's license plate and/or by reading the vehicle's transponder. Once identified, the vehicle may be recorded as having evaded the toll by improperly crossing the double white lines and a toll citation may be issued. Note, while FIG. 2 and FIG. 3 show the recording devices 203, 213, 223, 233, 243 located in the center median barrier, this is not required to practice the methods and system described herein. The recording devices may be placed in a plurality of locations as long as they are aligned such that they record the identity of the vehicle as it passes the location of the monitoring station. For non-limiting examples, the recording device may be embedded into the roadway or it may be deployed on overhanging gantries or bridges.

In one embodiment, notification of the status of a controlled lane or a multipurpose lane may be conveyed to drivers of vehicles through a plurality of methods including but not limited to posting signs, displaying information on the roadway surface, displaying messages on variable message signs along the roadway, displaying messages in in-vehicle systems, or displaying messages on internet websites.

Figure 6:
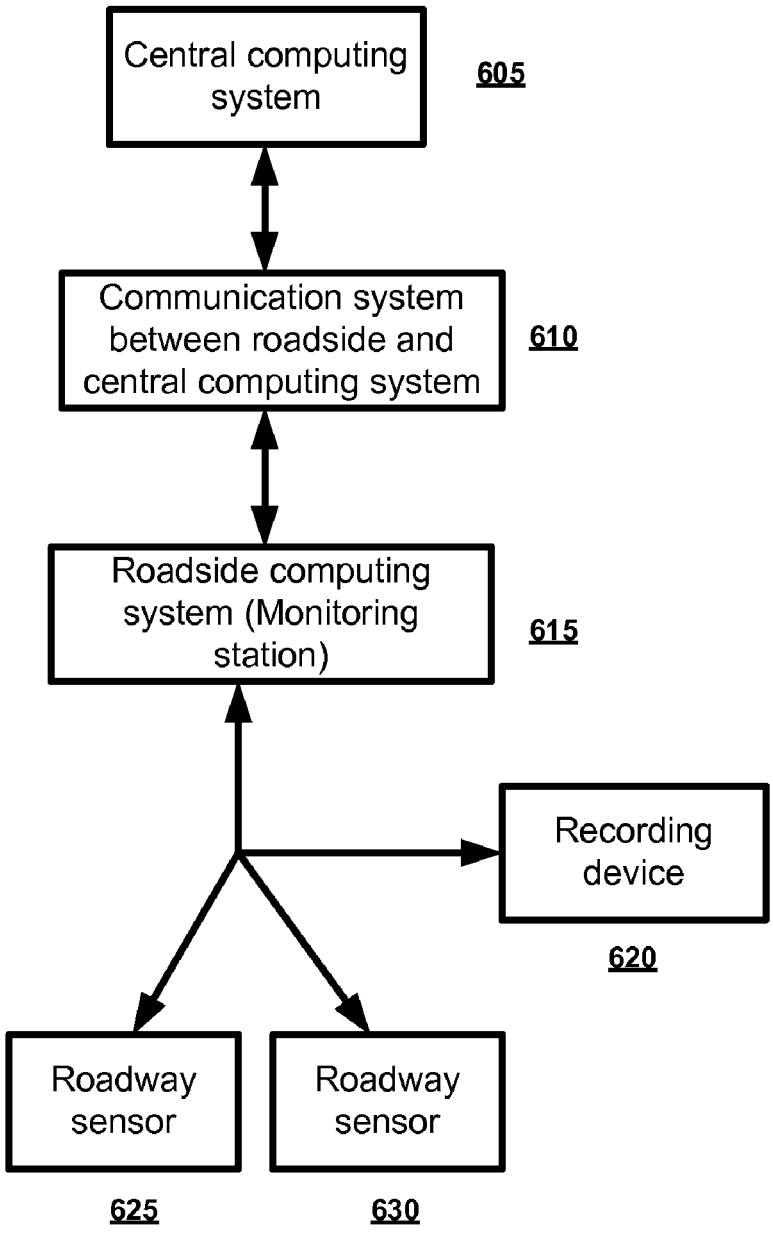
FIG. 6 illustrates a simplified, non-limiting block diagram of some logical components of the electronic barrier and automated enforcement system.

FIG. 6 illustrates an exemplary block diagram describing some logical components of the system, according to one embodiment. The overall system is controlled by a central computing system 605 (such as the one shown in FIG. 1) that, among other tasks, determines when the monitoring stations for a given lane in a roadway should be activated. The central computing system 605 may also receive data from the monitoring stations and recording devices to determine what action is necessary. Actions may include but are not limited to issuing citations for making improper lane changes or adjusting accounts associated with HOT functions. The central computing system may interact with various databases such as motor vehicle registration databases, commuter credit account databases, driver licensing databases, to name but a few non-limiting examples. The central computing system 605 receives through a communication system 610 data from a roadside computing system 615. In one embodiment, the roadside computing system 615 receives data from a plurality of roadway sensors 625, 630 and may also control the associated recording device 620. In another embodiment, the associated recording device 620 may be controlled by the roadway sensors 625, 630 receiving instructions to record the identity of a vehicle and relaying the information to either the roadway sensors 625, 630 and/or the roadside computing system 615.

Figure 7:
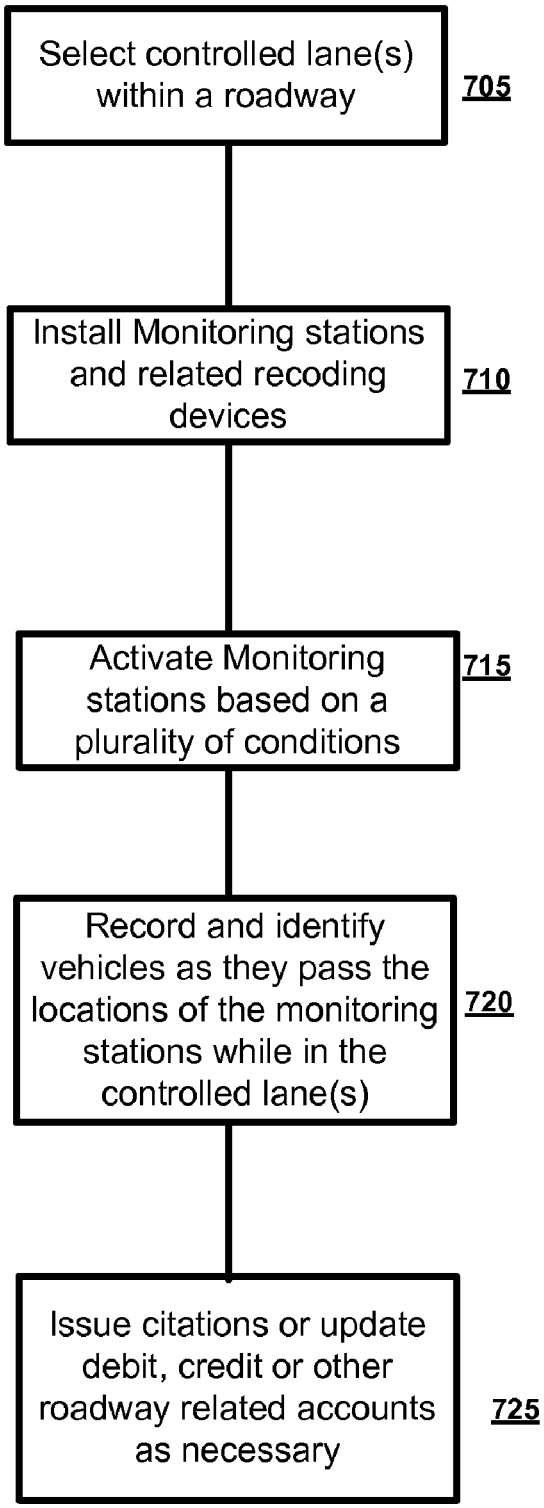
FIG. 7 illustrates an exemplary flow chart describing the steps to implement the method used by the electronic barrier and automated enforcement system, according to one embodiment.

FIG. 7 illustrates an exemplary flow chart describing the steps to implement a method used by the system, according to one embodiment. In step 705, a determination is made concerning which lanes in a roadway are to be designated as a controlled lane. In step 710, the lanes in the roadway selected to be controlled lanes are fitted with the electronic barrier system. The system may then be activated or deactivated based on a plurality of conditions in step 715. As vehicles pass the location of monitoring stations, in step 720, the vehicle may be identified and the information recorded. In step 725, the recorded information is used to issue citations or update debit, credit or other roadway related accounts as warranted.

Figure 8:
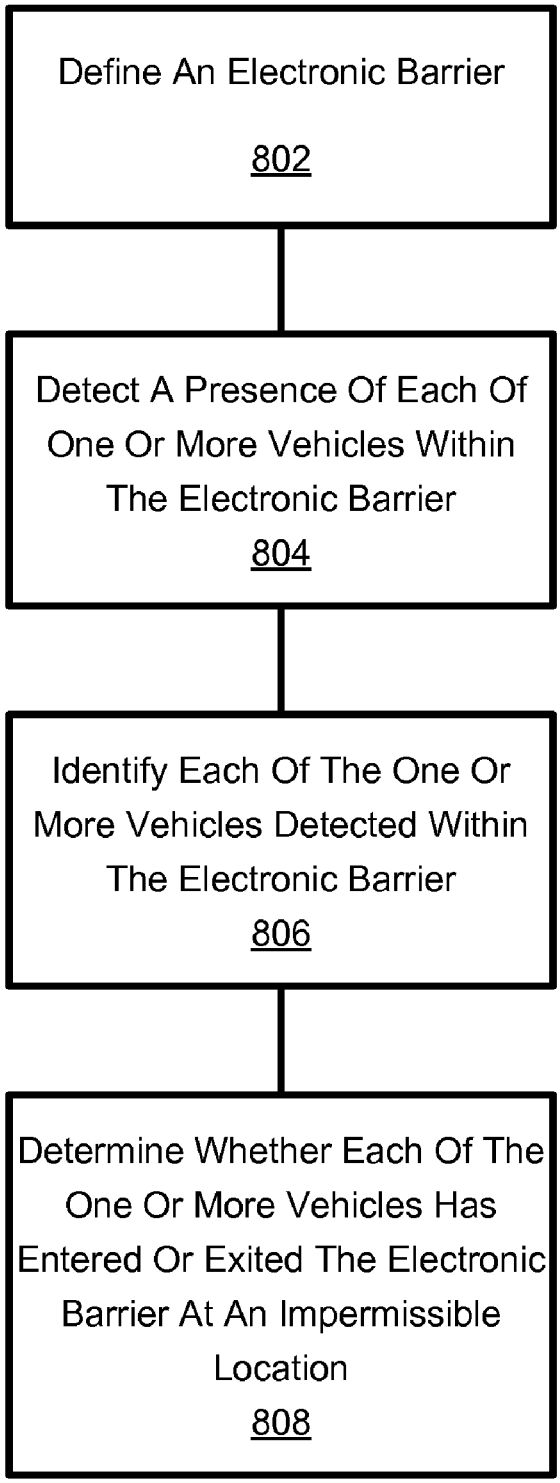
FIG. 8 illustrates an exemplary flow chart describing the steps to implement another method used by the system, according to one embodiment

FIG. 8 illustrates an exemplary flow chart describing the steps to implement another method used by the system, according to one embodiment. At step 802, an electronic barrier is defined. In one aspect, the electronic barrier can be defined as comprised of segments of one or more lanes of a roadway system and electronic barrier entry points and corresponding electronic barrier exit points. At step 804, the presence of each of one or more vehicles within the electronic barrier is detected. At step 806, the identity of the each of the one or more vehicles detected in the electronic barrier is determined. At step 808, it is determined whether the identified vehicle has entered or exited the electronic barrier at an impermissible location. In some instances, a toll can be assessed against the registered owner or other person identified with the vehicle if detected within the electronic barrier. Similarly, in some instance, a citation can be issued (either automatically or manually) against the registered owner or other person identified with the vehicle if detected within the electronic barrier.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as examples only, with a true scope and spirit being indicated by the following claims.

What is claimed is:

1. An electronic barrier and enforcement system comprising:

a processor;

a memory; and a plurality of sensing devices located along one or more lanes of travel of a roadway system and operably connected to the processor, wherein at least a portion of the plurality of sensing devices are configured to detect a presence of each of one or more vehicles in the one or more lanes of the roadway system, and wherein the at least a portion of the plurality of sensing devices are configured to transmit an output indicative of the presence of each of the one or more vehicles in a designated segment in the one or more lanes of the roadway system to the processor;

one or more identity devices operably connected to the processor, wherein the one or more identity devices are configured to identify each of said one or more vehicles detected by each of the at least a portion of the plurality of sensing devices, and wherein the one or more identity devices are configured to transmit the identity of each vehicle detected by each of the at least a portion of the plurality of sensing devices to the processor;

wherein said processor is configured to determine whether one of said one or more vehicles that is detected adjacent a first position by a first sensing device of the at least a portion of the plurality of sensing devices is also detected adjacent a second position by at least a second sensing device of the at least a portion of the plurality of sensing devices, wherein the first sensing device is an entrance sensing device located proximate the first position for detecting the one or more vehicles entering a the designated segment of the said one or more lanes of travel of the roadway system and the second sensing device is an exit sensing device located proximate the second position for detecting the one or more vehicles exiting the designated segment of the said one or more lanes of travel of the roadway system, and wherein, if one of said one or more vehicles that is detected by the entrance sensing device is not detected by the exit sensing device or if one of said one or more vehicles that is detected by the exit sensing device is not detected by the entrance sensing device, then the one of said one or more vehicles has committed a prohibited lane change, and the identity of the one of said one or more vehicles is recorded in the memory by the processor for use in automated issuance of a citation against a person identified with the one of said one or more vehicles.

2. The system of claim 1, wherein the at least a portion of the plurality of sensing devices further comprise the one or more identity devices.

3. The system of claim 1, wherein the processor is further configured to determine if one of said one or more vehicles that is detected by the first sensing device of the at least a portion of the plurality of sensing devices is not detected by the second sensing device of the at least a portion of the plurality of sensing devices, and wherein, when one of said one or more vehicles that is detected adjacent the first position by the first sensing device of the at least a portion of the plurality of sensing devices is not detected adjacent the second position by the second sensing device of the at least a portion of the plurality of sensing devices, the one of said one or more vehicles has committed a prohibited lane change, and the identity of the one of said one or more vehicles is recorded in the memory by the processor for use in automated issuance of a citation against a person identified with the one of said one or more vehicles.

4. The system of claim 1, further comprising a third sensing device of the at least a portion of the plurality of sensing devices, wherein the third sensing device is an intermediate sensing device located between the entrance sensing device and the exit sensing device and the intermediate sensing device is for detecting the one or more vehicles traveling in the designated segment of the said one or more lanes of travel of the roadway system.

5. The system of claim 4, wherein if one of said one or more vehicles that is detected by the intermediate sensing device is not detected by the exit sensing device, then the one of said one or more vehicles has committed a prohibited lane change, and the identity of the one of said one or more vehicles is recorded in the memory by the processor for use in automated issuance of a citation against a person identified with the one of said one or more vehicles.

6. The system of claim 4, wherein if one of said one or more vehicles that is detected by the intermediate sensing device is not detected by the entrance sensing device, then the one of said one or more vehicles has committed a prohibited lane change, and the identity of the one of said one or more vehicles is recorded in the memory by the processor for use in automated issuance of a citation against a person identified with the one of said one or more vehicles.

7. The system of claim 1, wherein the one or more identity devices comprise means for capturing an image of at least a portion of a vehicle.

8. The system of claim 1, further comprising:

a transportation operations database that comprises roadway segment information including one or more electronic barrier entry points and corresponding electronic barrier exit points, roadway operating conditions, and roadway segment toll price; and a vehicle registration database that links vehicle identity information to a registered vehicle owner or other designee;

wherein the processor is configured to compare the presence of each of one or more vehicles in the one or more lanes of the roadway system to the transportations operations database and whether one of said one or more vehicles that is detected by a first sensing device of the at least a portion of the plurality of sensing devices is also detected by at least a second sensing device of the at least a portion of the plurality of sensing devices to determine when a vehicle has illegally crossed into the one or more lanes of the roadway system; and wherein the vehicle identity information is compared to the vehicle registration database to determine the registered owners of the one or more vehicles in the one or more lanes of the roadway system and to determine whether a citation should be issued to the registered vehicle owner of the one or more vehicles in the one or more lanes of the roadway system.

9. The system of claim 8 wherein the electronic barrier entry and exit points can be flexibly configured and the electronic barrier can be shifted to cover as many lanes of a multi-lane roadway system as desired.

10. The system of claim 1, wherein electronic barrier locations comprising identification of the one or more lanes of the roadway system and electronic barrier entry points and corresponding electronic barrier exit points are communicated to drivers of vehicles via variable message signs.

11. The system of claim 1, wherein electronic barrier locations comprising identification of the one or more lanes of the roadway system and electronic barrier entry points and corresponding electronic barrier exit points are communicated to drivers of vehicles via an internet site and to an in-vehicle display system or to an hand-held device.

12. An electronic barrier and enforcement system comprising:

a processor;

a memory;

a plurality of sensing devices located along one or more lanes of travel of a roadway system and operably connected to the processor, wherein at least a portion of the plurality of sensing devices are configured to detect a presence of each of one or more vehicles in a designated segment of the one or more lanes of the roadway system, and wherein the at least a portion of the plurality of sensing devices are configured to transmit an output indicative of the presence of each of the one or more vehicles in the designated segment of the one or more lanes of the roadway system to the processor;

one or more identity devices operably connected to the processor, wherein the one or more identity devices are configured to identify each of said one or more vehicles detected by each of the at least a portion of the plurality of sensing devices, and wherein the one or more identity devices are configured to transmit the identity of each vehicle detected by each of the at least a portion of the plurality of sensing devices to the processor;

a transportation operations database that comprises roadway segment information including one or more electronic barrier entry points and corresponding electronic barrier exit points along the roadway segment; and wherein said processor is configured to determine whether one of said one or more vehicles that is detected by a first sensing device of the at least a portion of the plurality of sensing devices is also detected by at least a second sensing device of the at least a portion of the plurality of sensing devices, wherein the first sensing device is an entrance sensing device for detecting the one or more vehicles entering the designated segment of the said one or more lanes of travel of the roadway system and the second sensing device is an exit sensing device for detecting the one or more vehicles exiting the designated segment of the said one or more lanes of travel of the roadway system, wherein the processor is configured to compare the presence of each of the one or more vehicles in the one or more lanes of the roadway system to the transportation operations database and whether one of said one or more vehicles that is detected by the first sensing device is also detected by at least the second sensing device to determine when one of said one or more vehicles has illegally crossed into the one or more lanes of the roadway system at a prohibited location between an electronic barrier entry point and an electronic barrier exit point, and wherein, when one of said one or more vehicles has illegally crossed into the one or more lanes of the roadway system at a prohibited location, the identity of the one of said one or more vehicles is recorded in the memory by the processor for use in automated issuance of a citation against a person identified with the one of said one or more vehicles.

* * * * *